US009347217B2

(12) United States Patent
Feuer et al.

(10) Patent No.: US 9,347,217 B2
(45) Date of Patent: May 24, 2016

(54) INSULATING COVER FOR WALL OPENING

(71) Applicant: Green Sentry Solutions, Inc., New Rochelle, NY (US)

(72) Inventors: Robert Feuer, New Rochelle, NY (US); Paul Fiore, White Plains, NY (US); Randall Herlihy, Croton-on-Hudson, NY (US)

(73) Assignee: GREEN SENTRY SOLUTIONS INC., New Rochelle, NY (US)

( * ) Notice: Subject to any disclaimer, the term of this patent is extended or adjusted under 35 U.S.C. 154(b) by 0 days.

(21) Appl. No.: 14/692,675

(22) Filed: Apr. 21, 2015

(65) Prior Publication Data

US 2015/0300002 A1 Oct. 22, 2015

Related U.S. Application Data

(60) Provisional application No. 61/981,893, filed on Apr. 21, 2014.

(51) Int. Cl.
*E04B 1/76* (2006.01)
*E04B 1/66* (2006.01)

(52) U.S. Cl.
CPC .... *E04B 1/76* (2013.01); *E04B 1/66* (2013.01)

(58) Field of Classification Search
CPC ..... E04B 1/76; E04B 1/66; F24F 13/20; F24F 13/24; E04F 11/06; E06B 2009/005; E06B 9/00; E06B 1/34
See application file for complete search history.

(56) References Cited

U.S. PATENT DOCUMENTS 3,320,996 A * 5/1967 Singer ..... F24F 1/58 150/165
3,336,715 A * 8/1967 Savary ..... B21D 53/74 454/330
4,202,389 A * 5/1980 Ewald ..... F24F 13/20 150/165
4,303,289 A * 12/1981 Hardy ..... F16B 12/50 312/140
4,308,905 A * 1/1982 Gallagher ..... F24F 13/20 150/165
4,555,983 A * 12/1985 Bolton ..... F24F 13/32 248/27.1
4,788,805 A * 12/1988 Shaw ..... F24F 13/00 454/201

(Continued)

FOREIGN PATENT DOCUMENTS

FR EP 2743441 A1 * 6/2014 ..... E06B 9/17007

*Primary Examiner* — Rodney Mintz
(74) *Attorney, Agent, or Firm* — Donald J. Ranft; Kristen A. Mogavero; Collen IP

(57) ABSTRACT

Embodiments disclose an apparatus for enclosing and insulating an opening in a structure such as an air conditioning unit mounted in a sleeve. The apparatus includes one or more layers required depending on the distance which any equipment installed in the opening extends beyond the wall surface. An embodiment for a rectangular insulating cover apparatus includes corner pieces, horizontal wall pieces, and side wall pieces. Corner pieces are configured to allow the horizontal wall pieces and side wall pieces to be slid into the corner pieces. The depth of the insertion into the corner pieces can be varied depending on the desired dimensions for the insulating cover apparatus. After cutting the top cover the required dimensions for the opening in the insulating cover apparatus, top cover corner boots and C-channels are installed on the top cover which is then pressed into place. A method for assembling and installing the same is provided, as are other aspects.

13 Claims, 17 Drawing Sheets

(56) References Cited

U.S. PATENT DOCUMENTS 4,887,399 A * 12/1989 Berger ..... F24F 13/32 248/678
5,125,197 A * 6/1992 Fuchs ..... F24F 13/20 312/100
5,870,868 A * 2/1999 Kita ..... E04C 2/384 312/140
6,061,981 A * 5/2000 Nieves ..... F24F 13/20 52/202
7,328,589 B2 * 2/2008 Boone ..... F24F 13/082 62/262
7,757,510 B2 * 7/2010 Rosete ..... F24F 3/0442 312/257.1
8,178,781 B2 * 5/2012 Duffy ..... H02G 3/0418 138/92
8,357,031 B2 * 1/2013 Dinicolas ..... F24F 13/20 454/201
8,869,838 B2 * 10/2014 Herlihy ..... F24F 13/082 138/89
8,943,755 B2 * 2/2015 Herlihy ..... F24F 13/20 52/202
2008/0035635 A1 * 2/2008 Moffett ..... F24F 3/1603 220/4.28
2011/0006058 A1 * 1/2011 Kuhn ..... B65F 1/1426 220/9.4
2011/0303669 A1 * 12/2011 Herlihy ..... F24F 13/082 220/215
2012/0247720 A1 * 10/2012 Knetsch ..... H05K 7/20572 165/47
2013/0291440 A1 * 11/2013 Herlihy ..... F24F 13/20 49/463
2014/0044474 A1 * 2/2014 Broemstrup ..... H02B 1/303 403/205
2014/0044475 A1 * 2/2014 Broemstrup ..... H02B 1/303 403/205
2015/0135597 A1 * 5/2015 Gorman ..... F24F 13/12 49/456

* cited by examiner

INSULATING COVER FOR WALL OPENING

CROSS-REFERENCE TO RELATED APPLICATIONS

The present application claims priority to U.S. Provisional Patent Application Ser. No. 61/981,893 filed Apr. 21, 2014 and entitled "INSULATING COVER FOR WALL OPENING" which is hereby incorporated herein by reference in entirety for all purposes.

BACKGROUND

Some buildings and structures ("building") may include an opening or passage in an exterior wall thereof that passes from outside the building to inside a room in the building, and is used to house or mount an air conditioning unit ("A/C unit"). The opening may be referred to as an air conditioning sleeve ("sleeve"). To replace the air conditioning (A/C) unit mounted in the sleeve, the old A/C unit may be slid out from the sleeve, and a new A/C unit may then be slid into the sleeve. However, there may be instances where it may not be desirable to install a new A/C unit for some amount of time after the old A/C unit has been removed. Typically, the open ends of the sleeve may be closed by fitting a metal cap over the ends to prevent air from entering or leaving the building through the sleeve.

In some instances, instead of mounting an A/C unit in a sleeve, an A/C unit may be mounted in an opening created by an open window. To prevent outside air from entering the room through the vents in the A/C unit, a cover, such as a quilted cover, may be placed over the window mounted A/C unit.

Both sleeve mounted and window mounted A/C units may be a major source of heat loss from a building or structure during cold winter months. A/C units are not air tight and may allow colder outside air to migrate through the A/C unit and into the building. Additionally, cold air can blow through the gap between the sleeve interior and the A/C unit, and gaps between the window and the window-mounted A/C unit. The inability to prevent cold outside air from entering the building may result in a colder interior room, a loss of energy due to greater use of the heating equipment in the building, and increased expense.

While weatherization products, such as caulk or foam strips, for example, may be used, the air leakage gaps described above may still exist. Further, these weatherization products do not prevent the outside air from flowing through the A/C unit. Conventionally, people have used pillows, roll plastic, garbage bags with duct tape and textile A/C unit covers to try to prevent the outside air from flowing through the A/C unit. However, these products still typically allow outside air to flow inside, as the seal between the products and the sleeve or window may not be sealed to be air-tight.

Accordingly, there is a need for an improved cover for an air conditioning unit.

SUMMARY

The apparatus/device disclosed provides a means to secure an insulated cover for a wall opening. For rectangular openings the device comprises a cover made up of four corner pieces, four side walls and a cover; and four or more fasteners designed to secure the product to a structure in which the A/C unit or A/C unit sleeve is inserted. The device is designed to be adjustable in one or more dimensions—height, width, depth.

A method for installing the device is also disclosed. The method comprises determining a target length and height of a cover; adjusting the length and height of the cover to equal the determined target length and height; adjusting the top, bottom and two side wall components to desired lengths; this is accomplished by sliding all sides into corner pieces and then cutting the top cover to the desired dimension and securing the cover to a structure.

PART LIST

Figure 1:
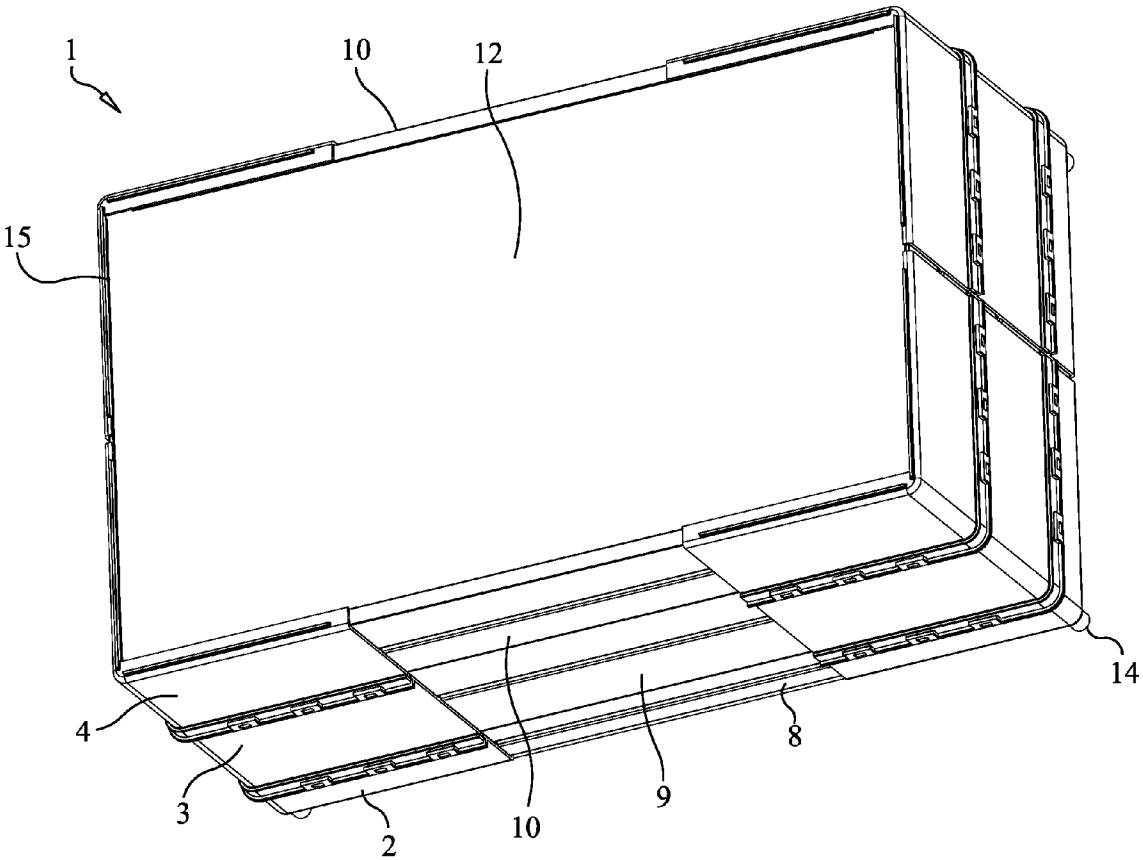
FIG. 1 depicts an insulating cover apparatus/device.

1. Insulating Cover Device
2. Top Corner
3. Filler Corner
4. Bottom Corner
5. Top vertical Wall
6. Filler Vertical wall
7. Bottom Vertical wall
8. Top Horizontal wall
9. Filler Horizontal wall
10. Bottom Horizontal wall
11. Top Cover

12. Bottom Gasket
13. Equipment Seal
14. Magnet
15. Marking Rib
16. Female Tab
17. Male Tab
18. Corner Boot
19. C-Channel
20. Ejector Boss
21. Ejector Boss Edge Hook
22. Fins
23. Metal Plate
24. Film Covering Sticky side of Metal Plate (23)
25. Small Lip
26. Pull Tab

DETAILED DESCRIPTION

Embodiments of the present invention provide apparatus and methods for securing a cover over an opening in a structure. A typical use is for an A/C unit or A/C unit sleeve but this can also be used for other openings in structures. One embodiment of the present invention provides an adjustable cover which fits over an A/C unit or sleeve and limits or eliminates air flow in and out of the A/C unit or sleeve. The length and width of the cover may be adjusted to accommodate different sized A/C units and sleeves. The product can also be produced in multiple depths to accommodate the specific A/C unit installed in either the window or sleeve.

In terms of window A/C units, the cover allows the A/C unit to remain in the window for all seasons, instead of removing the window A/C unit at the end of the A/C unit using season (e.g. fall, winter). Further, in terms of the sleeve, if no A/C unit is placed in the sleeve or other opening in a wall, the cover may remain over the sleeve indefinitely. The insulating cover device allows for a semi-permanent installation whereby the cover is the only component that is removed during the summer or warmer months.

The term structure is broadly used to mean any enclosure which is usually a building but it could even be a device or a truck trailer for example. The term sleeve refers to a sleeve typically installed through a wall. An AC unit (or other device besides an air conditioning unit) is inserted into the sleeve. An AC unit refers to an air conditioner typically installed in a window. But the AC unit has an AC sleeve. Thus referring to a sleeve in this specification and claims refers to the sleeve intended to be located through a wall or the sleeve intended to be inserted into a window opening. In both cases the sleeves are designed for housing an A/C unit. But sleeves can also be designed to house other non A/C units.

The shape of the insulating cover device can be configured to match the opening to be covered. FIGS. 1 to 28 depict an insulating cover device for a rectangular opening. Since the distance that an A/C unit (or other equipment in an opening in the wall) extends from the wall varies, the insulating cover device allows multiple layers to be added.

Figure 2:
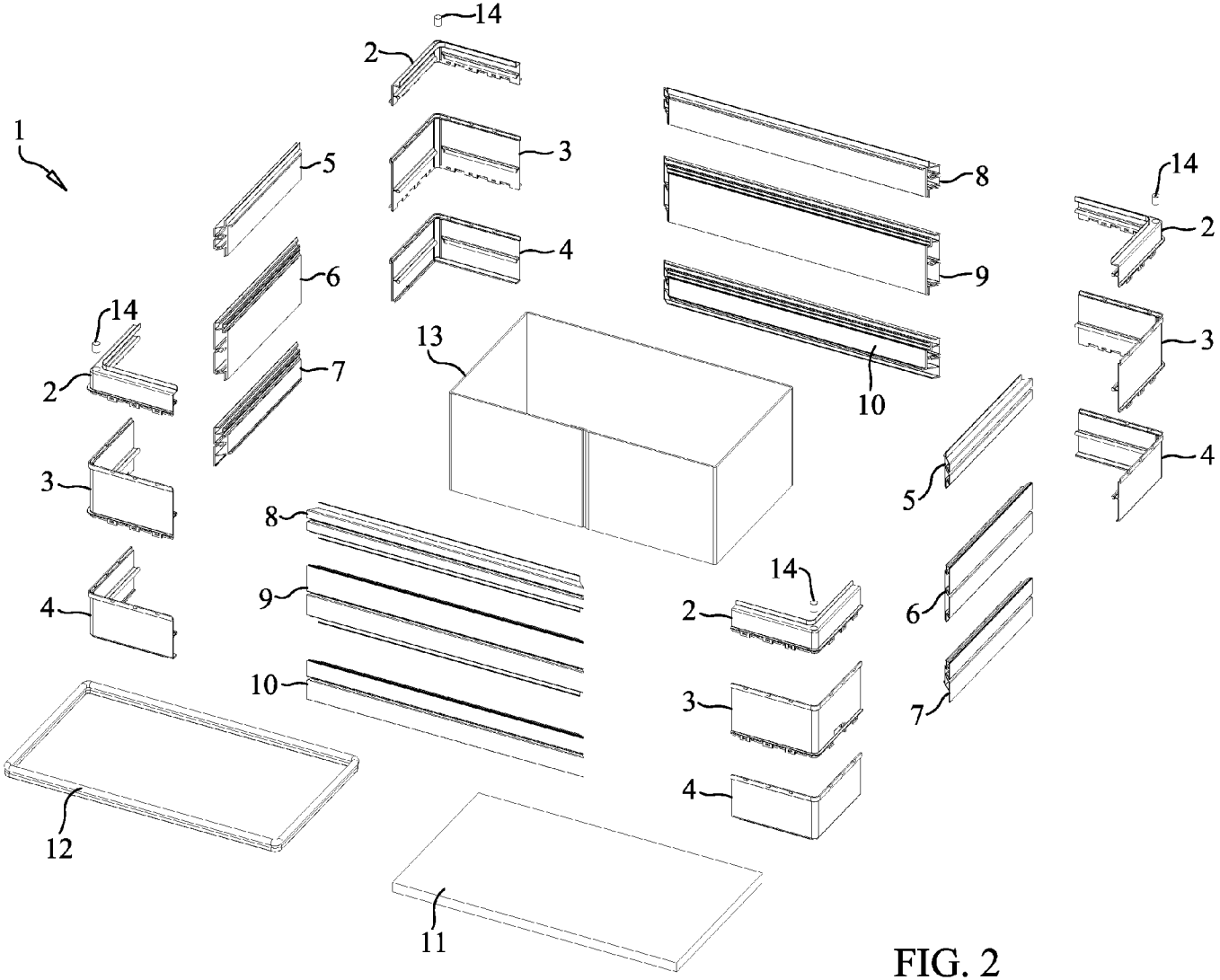
FIG. 2 depicts an exploded view of the device and its parts.
Figure 3:
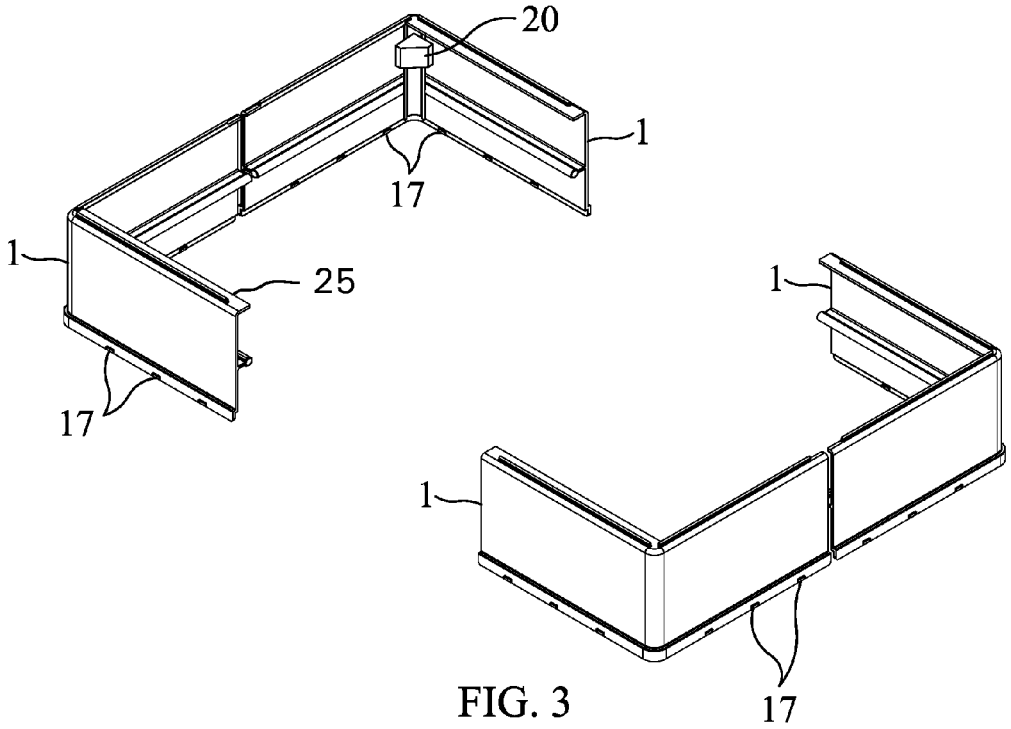
FIG. 3 depicts a perspective view of a top corner pieces.
Figure 4:
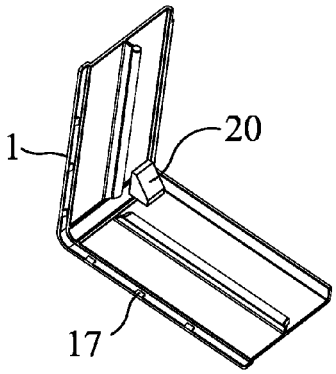
FIG. 4 depicts a perspective view of a top corner piece.
Figure 5:
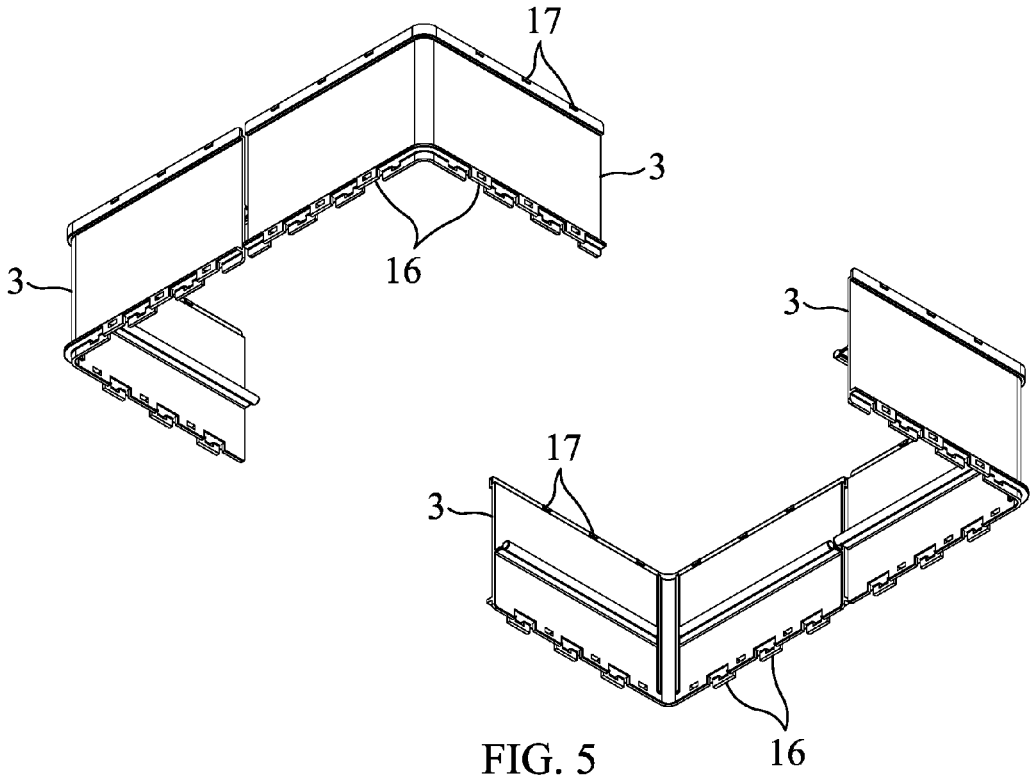
FIG. 5 depicts a perspective view of filler corner pieces.
Figure 6:
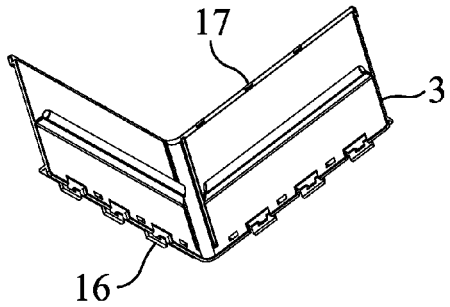
FIG. 6 depicts a perspective view of a filler corner piece.
Figure 7:
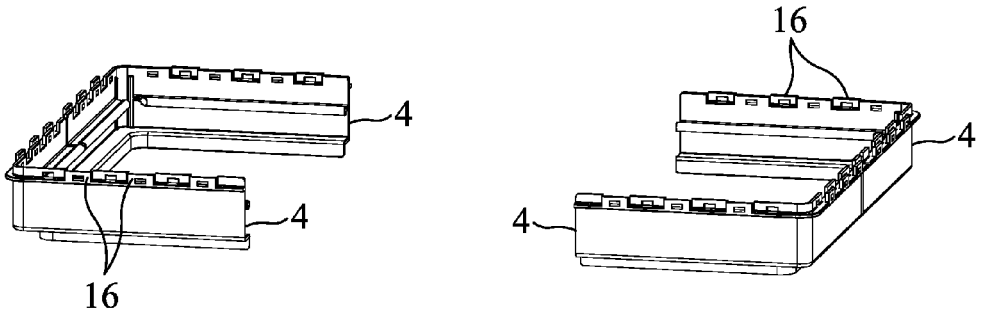
FIG. 7 depicts a perspective view of bottom corner pieces.
Figure 8:
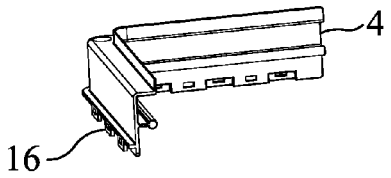
FIG. 8 depicts a perspective view of a bottom corner piece.
Figure 9:
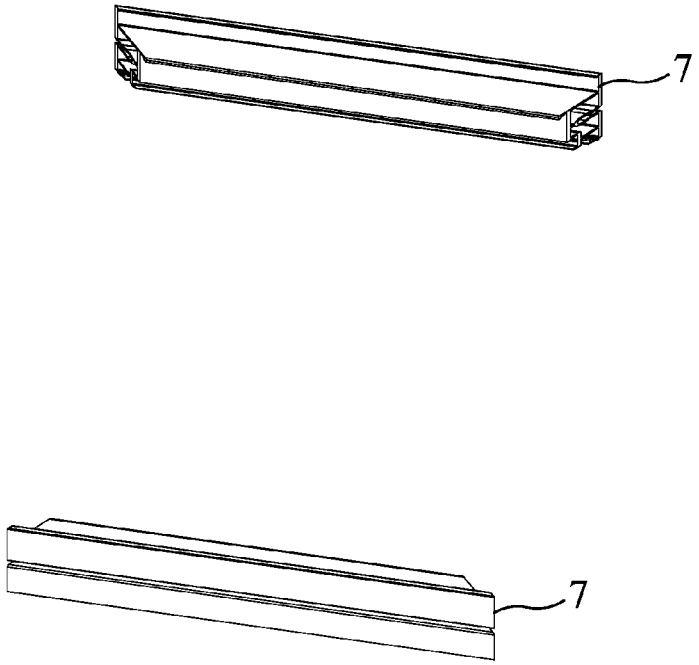
FIG. 9 depicts front and back perspective views of a top vertical wall piece.
Figure 10:
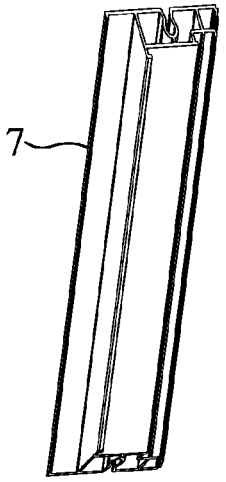
FIG. 10 depicts a perspective view of a top vertical wall piece.
Figure 11:
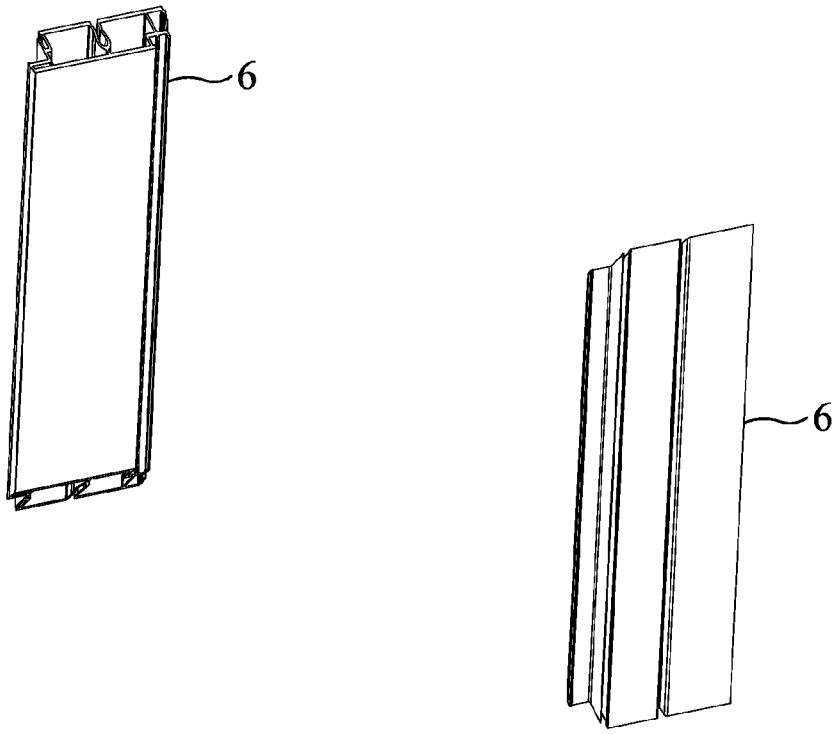
FIG. 11 depicts front and back perspective views of a filler vertical wall piece.
Figure 12:
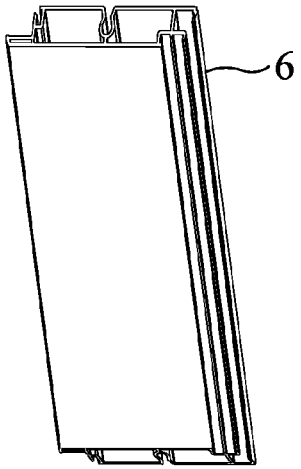
FIG. 12 depicts a perspective view of a filler vertical wall piece.
Figure 13:
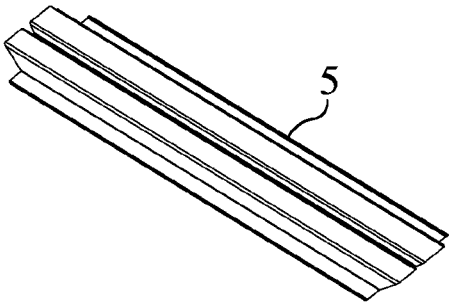
FIG. 13 depicts front and back perspective views of a bottom vertical wall piece.
Figure 13:
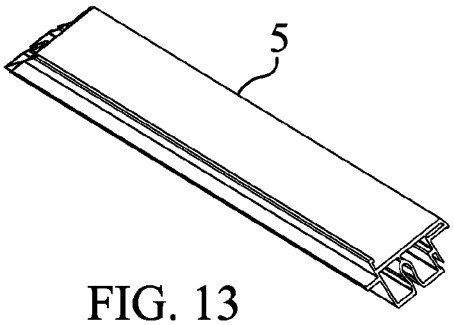
Figure 14:
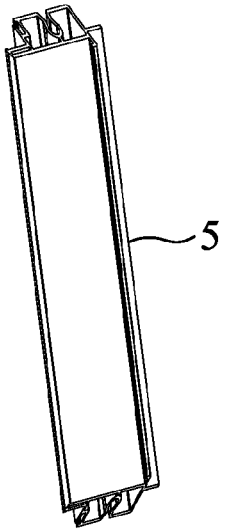
FIG. 14 depicts a perspective view of a bottom vertical wall piece.
Figure 15:
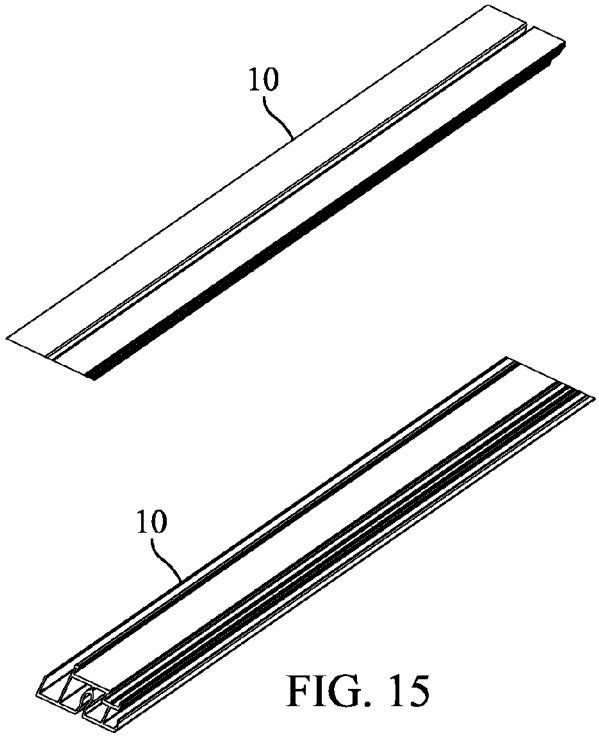
FIG. 15 depicts front and back perspective views of a bottom horizontal wall piece.
Figure 16:
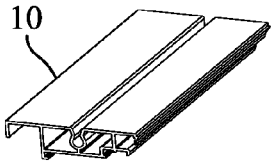
FIG. 16 depicts a perspective view of a bottom horizontal wall piece.
Figure 17:
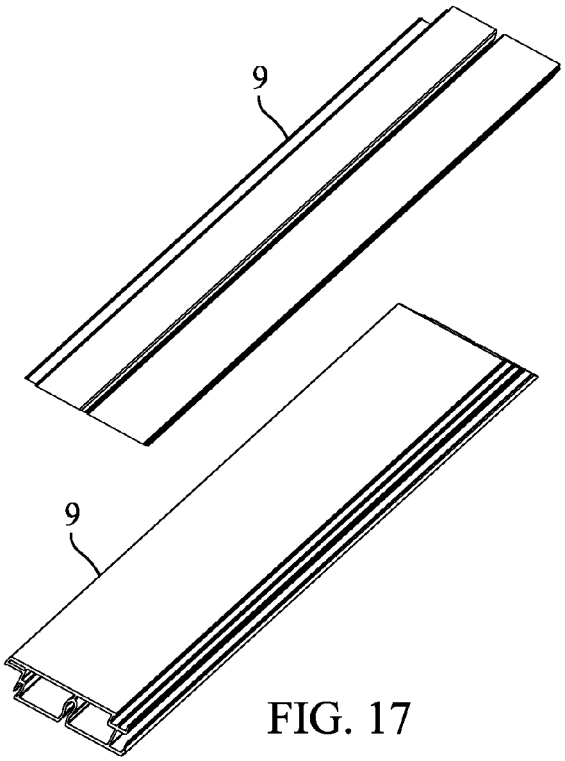
FIG. 17 depicts front and back perspective views of a filler horizontal wall piece.
Figure 18:
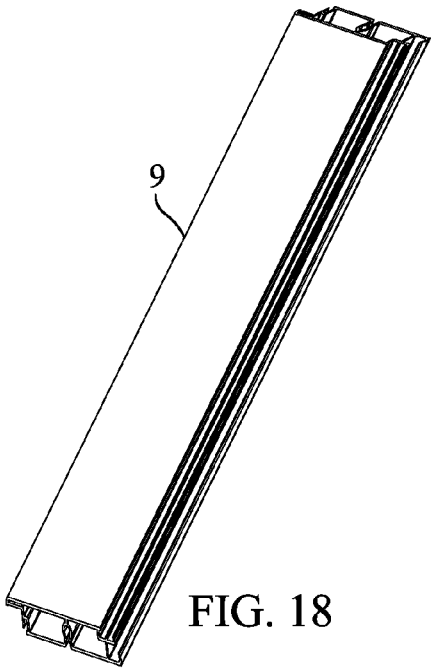
FIG. 18 depicts a perspective view of a filler horizontal wall piece.
Figure 19:
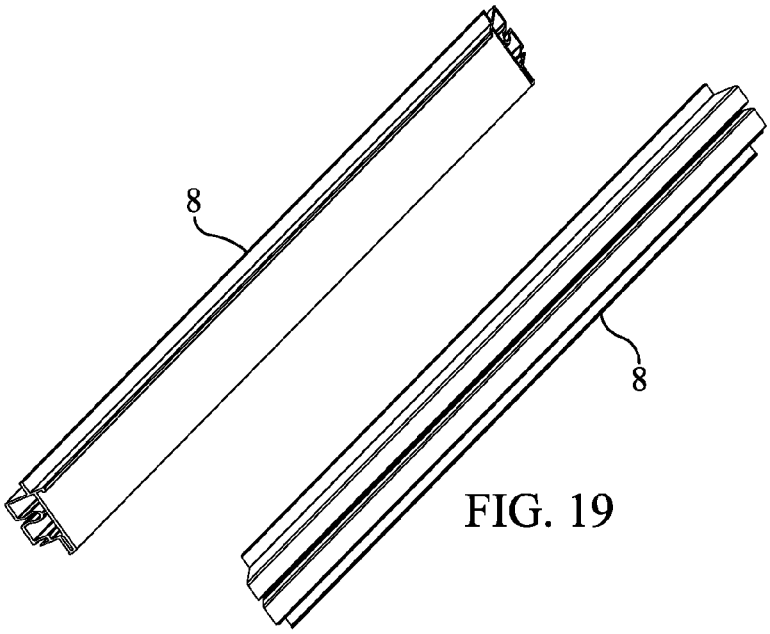
FIG. 19 depicts front and back perspective views of a top horizontal wall piece.
Figure 20:
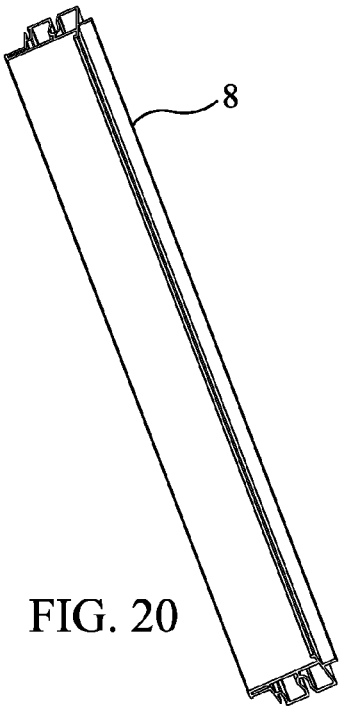
FIG. 20 depicts a perspective view of a top horizontal wall piece.

FIGS. 1 & 2 depict a configuration with three layers but any number of layers can be utilized as warranted. Each layer includes four corner pieces (2, 3, & 4), four short side wall pieces (5, 6, & 7), and four horizontal side wall pieces (8, 9, & 10). If the rectangle is a square all the side wall pieces are of equal length. The insulating cover device also includes a top cover (11), and a bottom gasket (12). The bottom/innermost layer includes attachment devices which can be any design well known by those skilled in the art such as magnets (14) for attachment to the surface surrounding the opening. The figures show the attachment devices in each of the corners but more can be added in other locations as warranted to secure the insulating cover device to the surface surrounding the opening. An equipment seal (13) can also be included to be secured to the device or sleeve prior to installing the insulating cover device (1).

Figure 21:
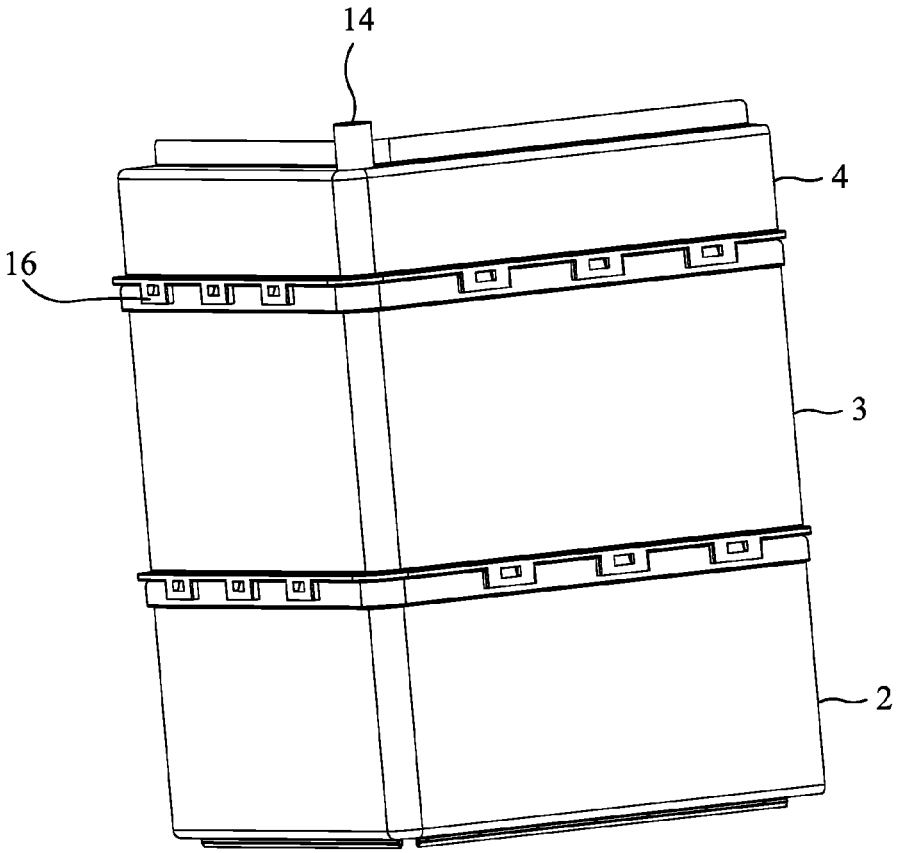
FIG. 21 depicts a side perspective view of the device.

The layers are designed to be secured to each other. Various means well known to those skilled in the art can be utilized for securing the layers to each other. FIG. 21 depicts a female tab (16) and a male tab (17) for securing pieces from different layers together. The innermost/bottom layer (4, 7, & 10) is the layer which is attached to the surface surrounding the opening to be covered. The gasket (12) is designed to be secured to the innermost layer. The cover is designed to be secured to the outermost/top layer (2, 5, & 8). If only one layer is required then that layer is designed to accept the gasket and the cover. If warranted one or more filler layer (3, 6, & 9) as shown on the drawings can be included. FIGS. 3-20 depict multiple views each of the pieces each layer.

In one embodiment the insulating cover apparatus includes an enclosure configured with multiple layers with each layer having a front and a back. Each layer includes: four corner pieces with two top corners and two bottom corners, a horizontal wall piece configured for insertion into the two top corners, a horizontal wall piece configured for insertion into the two bottom corners such that the two horizontal walls are opposite and parallel each other. Two side wall pieces are opposite to each other and perpendicular to the top and horizontal wall pieces, with each of the two sidewall pieces configured for insertion into one of the top corners and of the bottom corners. The cover apparatus also includes two or more attachment devices. Each attachment device is configured to attach the back of the innermost layer and to a surface surrounding the opening in the structure which is to be enclosed by the insulating cover apparatus. A gasket is attached to the back to the enclosure to press against the surface surrounding the opening. And a cover is cut to the appropriate size and installed on the front of the enclosure.

The corners of the insulating cover device may be made from any rigid or semi-rigid material such as plastic that is injection molded and for example molded out of 0.65 mm plastic. Other suitable materials, thicknesses, and methods of formation may be used. In one embodiment the corner or wall pieces of both are extruded out of PVC and can be made to any length width and thickness desired.

The insulating cover device is depicted in FIG. 1 with its top cover (11). The top cover (11) is sized and shaped to approximately conform to the opening in the top of the insulating cover device. While the top cover (11) is shown having a rectangular shape, any suitable geometric shape may be used. The top cover (11) can be made of any rigid or semi-rigid material suitable the desired insulation. Rigid high density foam is one such material which can be used.

In one configuration: the vertical side is 12.5 inches in length: 4 inches in height, the horizontal side is 20 inches in length, 4 inches in height; and the walls are ¾ to ⅞ths of an inch thick. The height can be increased by adding filler pieces. All the dimensions of the wall pieces can be created as warranted for a particular opening and piece of equipment to be covered.

Figure 22:
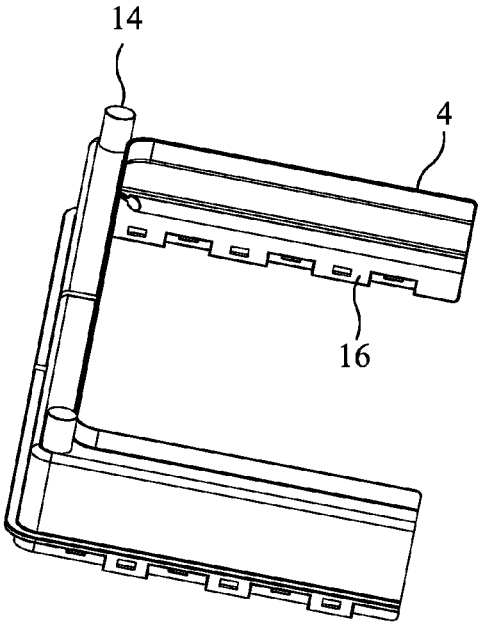
FIG. 22 depicts a portion of the bottom layer showing the gasket track
Figure 23:
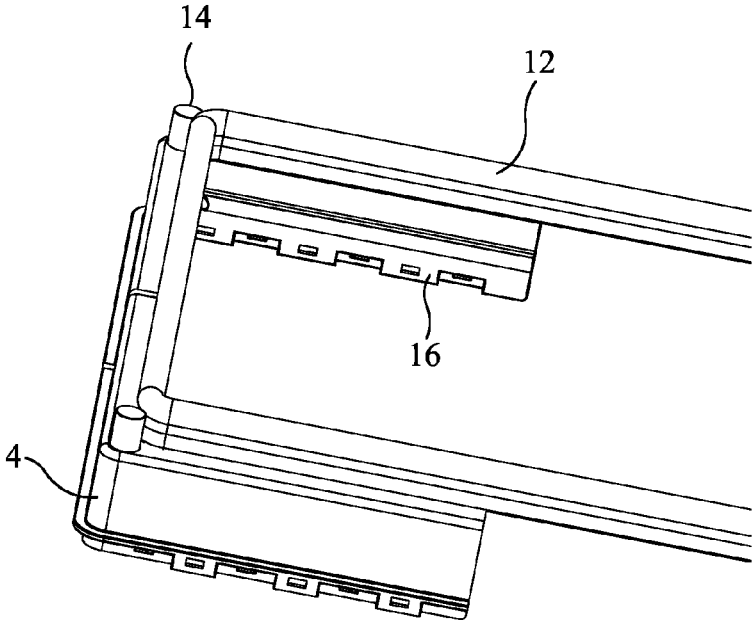
FIG. 23 depicts a portion of the bottom layer with the gasket.

The corner pieces, the vertical wall pieces, and the horizontal pieces in one layer are configured to allow attachment to corresponding adjacent pieces in an adjacent layer. FIG. 21 shows female tabs (16) and male tabs (17) utilized to snap the parts in different layers together. The bottom gasket (12) is placed around the perimeter of the bottom layer pieces in the gasket track (22). FIG. 22 shows the gasket track (22) on the bottom edge of the bottom layer. FIG. 23 shows a gasket (12)

installed in the gasket track (22). The gasket (12) may be made out of rubber or foam and can be press fit onto the gasket track (22).

Figure 24:
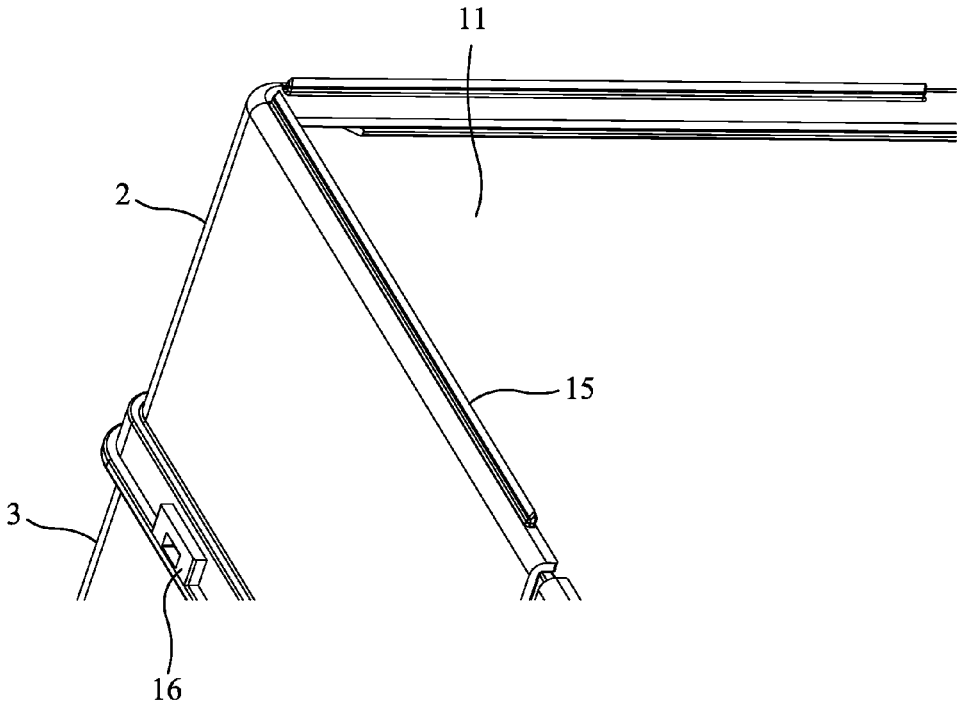
FIG. 24 depicts portion of the top layer showing the cover stamp edge.

As shown on FIG. 24 a marking rib (15) is located on the top/outermost pieces of the insulating cover device (1). The marking rib (15) can also be located on the bottom/innermost pieces. The marking rib (15) enables the installer to mark the top cover (11) for cutting it to the required size. After the walls layers are assembled, the installer places the top cover (11) on the marking rib (15) and presses down. After marking the top cover (11) show in FIG. 25, it can be cut to the required size.

In another embodiment the insulating cover device only has one adjustable side. As in this embodiment either the length side of the insulating cover device or the width side of the insulating cover device is fixed. This embodiment can also include retractable top cover.

If desired by the owner/user insulating cover device can be left in place all year round after removing the top cover. The advantage this provides to the user is that they will not have to store the insulating cover device in the off season. The user simply has to remove or retract the cover when ready to use the air conditioner.

Figure 26:
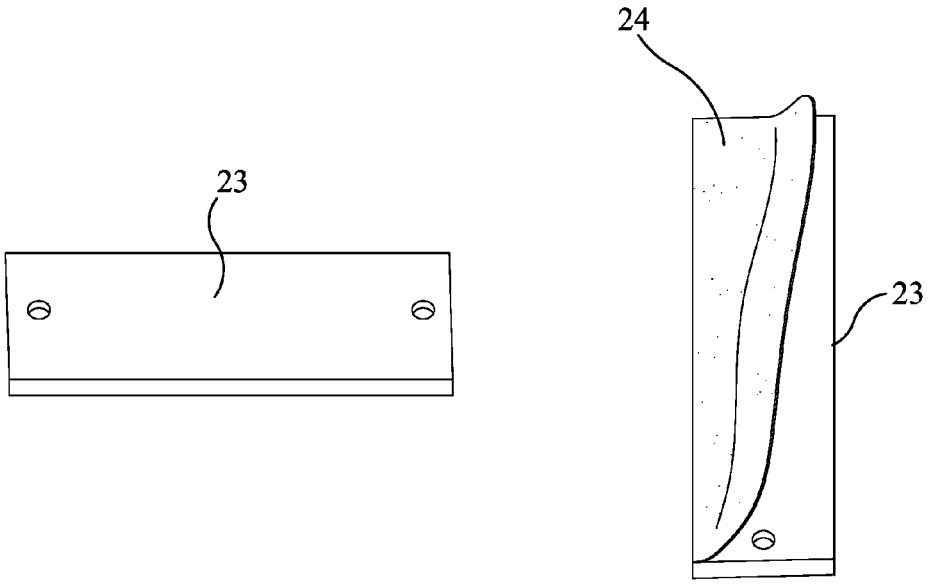
FIG. 26 depicts a metal plate.
Figure 27:
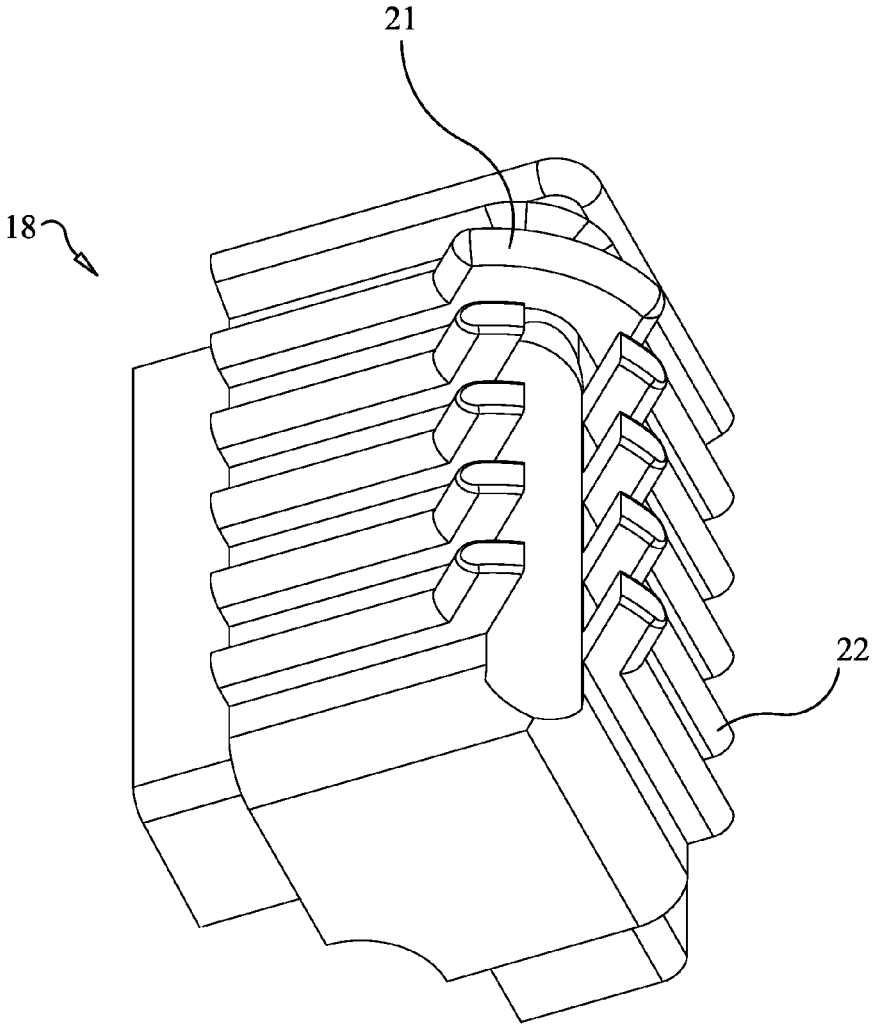
FIG. 27 depicts a corner boot.

FIG. 26 shows an insulating cover device utilizing magnets as the attachment devices and located in each of the corners on the bottom layer. If a metal surfaces is not available on the wall one embodiment provides a device and method to properly locate a metal plate on the surface of the wall. As shown on FIG. 27, to provide a metal surface, a metal plate (23) with a sticky surface on one side covered with a removable film (24) is utilized. Other attachment devices such as hook and loop device or latching mechanism can also be utilized. These attachment devices can be two pieces wherein one piece is configured as a hook piece and a second piece is configured as a loop piece, with one piece attached to back of the enclosure and the other piece attached to the surface surrounding the opening in the structure which is to be enclosed.

These additional attachment device configurations can be provided with a sticky surface on one side of the component needed to be secured to a surface of the wall. Or the part of the attachment device to be secured to a wall surface can be mounted in other ways such as nails or screws. If the attachment device includes a sticky portion to be secured to the surface of the wall, after securing the attachment device to the insulating cover apparatus the film (24) is removed exposing the sticky surface. The insulating cover device is then pressed against the wall thereby securely attaching the portion of the attachment device intended to be secured to the wall. In one the attachment devices are configured to allow adjustment of a distance which each attachment device extends from the insulating cover apparatus.

One method for assembling the pieces of the insulating cover device is to attach similar components in each of the layers together, i.e. attach all the corner pieces (2, 3, & 4) together, attach all the vertical wall pieces (5, 6, & 7) together, and attach all the horizontal wall pieces (8, 9, & 10) together. In this embodiment the assembled/snapped together walls are then slid into the corner pieces. This sliding motion enables the product to be adjusted to many desired dimensions. In one embodiment the walls are made of the same rigid foam as the corners. But the walls and corners can be made from other suitable materials. Once all four walls are connected to the four corners they create a complete rectangular frame as seen on FIG. 1.

The corner pieces are designed to allow the horizontal and vertical wall pieces to be slid into them. The height and width of the insulating cover device can be varied by changing the depth to which each horizontal wall and vertical wall piece is inserted into the corner pieces. This enables the insulating cover device to be utilized for openings of various heights and widths.

The completed frame is then mounted around the window air conditioner or the through the wall air conditioning sleeve or other opening. In this embodiment the mounting of the frame is achieved as follows. Both portions of the attachment devices are joined together and attached to the insulating cover device. Removable film (24) is removed to expose the sticky surface of the portion to be secured to the wall, window sill, window frame, or other surface surrounding the opening to be insulated. The insulating cover device is then pressed against the intended surface to secure the attachment device to the intended surface surrounding the opening.

Once the insulating cover device without its top cover (11) is attached to the intended surface surrounding the opening, the top cover (11) can be cut to the exact size of the opening in the top/outermost layer and installed on the insulating cover device. In order to install the pressure fitting top cover (11) the cover needs to be cut to size. The top cover (11) is cut to the proper height and width by marking the foam with the marking rib (15). The marking rib (15) makes a perfect outline of the exact cover size needed for the product dimensions already set. The marking rib (15) can be located on either the front or back of the product depending on the specific design of the product. After the outline is created by pressing the marking rib (15) onto the full size top cover (11) piece, the top cover (11) can be cut to the correct height and width.

Next the corner boot (18) is placed on the four corners of the top cover (11). This corner boot (18) is designed to fit into the top inside corner of the top corner pieces (4). The corner boot (18) fits over an ejector boss (20) inside the corners (4). The ejector boss (20) is designed to ensure that the top cover (11) is not pushed in too deep after it is completely assembled.

C-channels (19) are then cut to fit each of the four edges of the front cover between 2 corner boots (18). These four C-channels (19) have small fins (22) that when placed on the product air-seal the unit. The front cover is then fitted (all 4 sides) with cut-to-size C channels which also have fins (22). The 4 corners boots (18) also have fins. Each end of each C-channels slides into a corner boots (18) so that each corner boot has a vertical C-channel and a horizontal C-channel connected to it. The entire perimeter of the top cover (11) is now lined with fins (22).

The top cover (11) can now be inserted into the top of the insulating cover device by press fitting the top cover (11) just past the small lip (25) which is located on each of the corner pieces, vertical pieces, and horizontal pieces comprising the outermost layer of the insulating cover device (1). The entire perimeter of top/outermost pieces (2, 5, & 8) of the insulating cover device (1) has a small lip (25) which helps to hold the cover in a consistent position. The small lip (25) is shown on FIG. 3. This small lip (25) in combination with the pressure created by the fins air seals the top of the insulating cover device for winter when air sealing mode is warranted.

Figure 25:
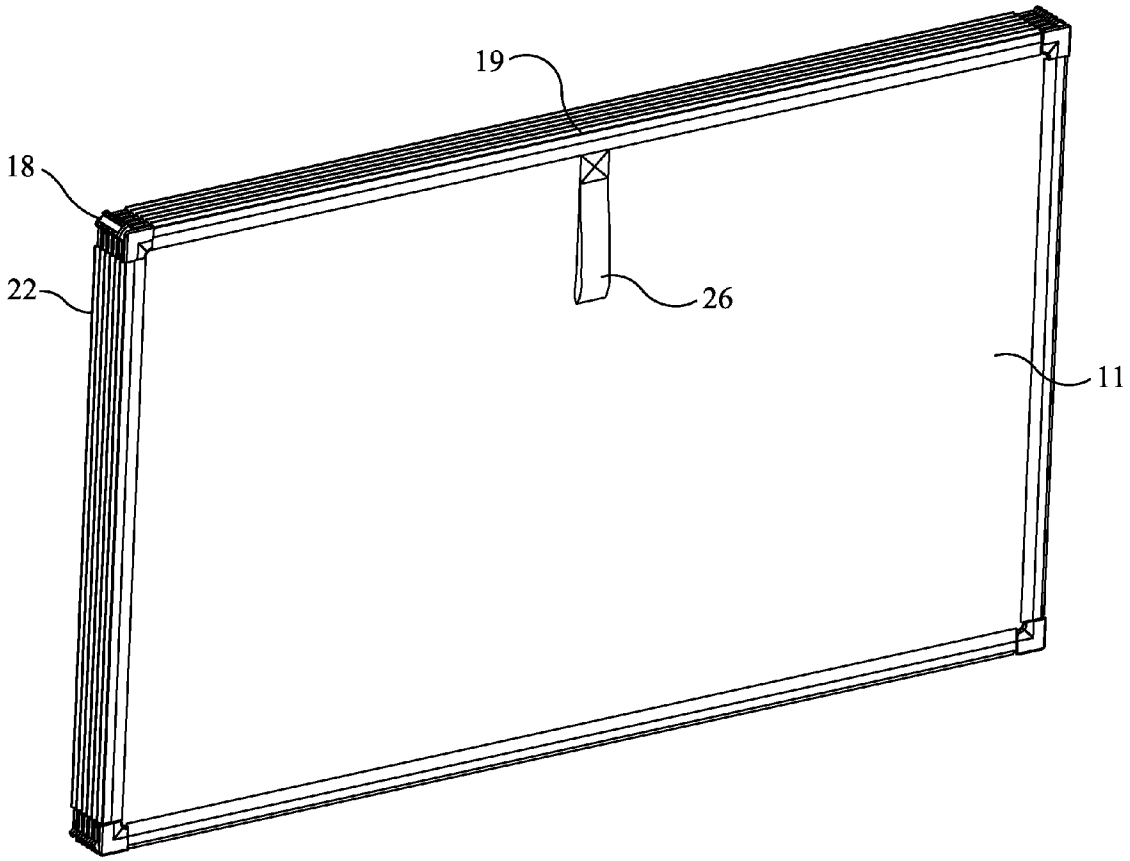
FIG. 25 depicts a top cover.

Referring to FIGS. 24 and 25, one method for cutting and installing the top cover (11) is as follows. The method includes cutting a target length and width of the cover ensuring that it is wider than the area to be covered by the insulating cover device. The top cover (11) is then pressed against the marking rib (15) creating an impression on the top cover (11). The top cover (11) is then cut to the needed size. After attaching the corner boots (18) and C-channels (19), the top cover (11) is then installed on the insulating cover device (1).

One method to assemble and install the insulating cover device over a window mounted A/C unit is as follows:

1. Determine the width of the product by measuring the window frame from inside edge to inside edge.
2. Determine the height of the product by measuring the distance from the window sill to the center of the top widow sash.
3. Determine the depth of the product by measuring the distance from the sash to the outside edge of the Air Conditioner Face.
4. For 4 inch or less depth required use all parts accept the filler pieces; for 8 inch or more depth required use all parts including the filler pieces as warranted.
5. All Top, Filler and Bottom pieces of like size snap together by pressing the female and male tabs together. All of the completed horizontal and vertical walls slide into the corner pieces; so once the proper depth is determined snap all needed pieces together.
6. Start by sliding all walls as far as possible into the corner pieces.
7. Slide the horizontal and vertical walls to the desired measurements to customize the size of the insulating cover apparatus. The sliding of the walls in or out of the corners will adjust to the desired size. The walls can be manufactured at small medium and large sizes to accommodate any desired window dimension. The insulating cover apparatus are configured to allow a range f height and width depending on the opening to be covered. For example the insulating cover apparatus may be designed to allow a 10 inch range in both width and height adjustments.
8. Place the continuous gasket 12 above around the bottom perimeter of the product in the track provided. Cut off the excess and place both ends in the gasket coupling provided.
9. Place the attachment devices with a sticky surface on the part of the attachment device to be mounted on the wall surface in the designated areas on the bottom four corners of the product. (the height of the attachment devices (e.g. magnets) can be adjusted up and down if needed).
10. Peel the removable film off the stick coating on the portion of the attachment device to be mounted on the wall surface.
11. Put the insulating cover apparatus in place and press the four corners so that the adhesive on the strike plates adheres to the sash and wall surface for through the window or on the wall for sleeve applications.
12. Pull the insulating cover apparatus off of the strike plates and you are ready to adjust or cut the front cover.
13. Place the rigid foam cover on a flat surface.
14. Press the top perimeter of the top cover onto the face of the rigid foam. The raised ridge on the face will make a continuous circle that will be used as a guide to cut the foam cover to the correct size.
15. Cut the excess foam away from the top cover with a pan or utility knife.
16. Place the four corner boots on the corners of the front/top cover.
17. Cut the C-channels with fins to fit between the corner boots.
18. Press all C-channel pieces into place so that the C-channel fits between the corner boots.
19. Next place the insulating cover apparatus back on the wall by lining up each of the pieces of the attachment devices to their mate which is now on the wall (or sash or sill) surface.
20. Now you can press fit the top cover in place by pressing the top cover past the small lip that runs the top perimeter of the insulating cover apparatus. The corner boots will fit cleanly onto the ejector boss in each corner. This will assure that the cover is not pushed down too far.
21. The fins that surround the entire C-channel and therefor the front cover provide an air seal for the product. On the front/top cover is a pull tab (26) that can be used to remove the cover after the Winter Season. Just pull on the tab (26) and the top cover will come off the insulating cover apparatus.

While the insulating cover device is designed to allow various modifications and alternative forms, specific embodiments and methods thereof have been shown by way of example in the drawings and are described in detail herein. It should be understood, however, that it is not intended to limit the invention to the particular apparatus, systems, or methods disclosed, but, to the contrary, the intention is to cover all modifications, equivalents, and alternatives based on this disclosure. For example, in one or more embodiments when the A/C unit is in the window, if the window is a double hung window additional insulation pads may be placed in the gap between the upper window frame and the lower window frame. This insulating cover device can also be used to cover other openings in a structure such as openings for exhaust fans when not in use or attic stair openings, even windows.

Still other aspects, features, and advantages of the present invention may be readily apparent from the following detailed description by illustrating a number of example embodiments and implementations, including the best mode contemplated for carrying out the present invention.

The present invention may also be capable of other and different embodiments, and its several details may be modified in various respects, all without departing from the scope of the present invention. Accordingly, the drawings and descriptions are to be regarded as illustrative in nature, and not as restrictive. The invention is to cover all modifications, equivalents, and alternatives falling within the scope of the invention. Accordingly, while the insulating cover device is disclosed in connection with exemplary embodiments thereof, it should be understood that other embodiments may fall within the spirit and scope of the invention, as defined by the following claims.

We claim the following:

1. An insulating cover apparatus for an A/C unit comprising:

an enclosure configured with at least one layer having a front and a back;

the at least one layer including:

four corner pieces consisting of two top corner pieces and two bottom corner pieces;

a first horizontal wall piece configured for insertion into the two top corner pieces;

a second horizontal wall piece configured for insertion into the two bottom corner pieces;

two side wall pieces arranged opposite to each other and perpendicular to each of the horizontal wall pieces with each of the two sidewall pieces configured for insertion into one of the top corner pieces and one of the bottom corner pieces;

two or more attachment devices configured to connect the back of the at least one layer and to a surface surrounding an opening in a structure which is to be enclosed by the insulating cover apparatus;

a gasket attached to the back of the enclosure;

a top cover configured to be installed on the front of the enclosure after being cut to a size of the opening formed in the front of the enclosure; and a corner boot mounted on each corner of the top cover and a C-channel mounted on the top cover in between each of the corner boots.

2. The insulating cover apparatus according to claim 1 in which the gasket is inserted into a gasket track on the back of the enclosure.

3. The insulating cover apparatus according to claim 1 in which the attachment devices are magnets and optionally include a metal plate with a sticky surface for attachment to the surface surrounding the opening in the structure to be enclosed and a removable film covers the sticky surface.

4. The insulating cover apparatus according to claim 1 in which the attachment devices are configured to allow adjustment of a distance which each attachment device extends.

5. The insulating cover apparatus according to claim 1 in which the at least one layer is two or more layers as warranted by the opening in the structure which is to be enclosed by the insulating cover apparatus, with each layer attached to an adjacent layer, with an innermost layer forming the back of the enclosure and an outermost layer forming the front of the enclosure.

6. The insulating cover apparatus according to claim 5 further comprising a seal wrapped around a piece of equipment extending away from a wall into the structure.

7. The insulating cover apparatus according to claim 5 which the corner pieces, the side wall pieces, and the horizontal pieces in one layer are configured to allow attachment to corresponding adjacent pieces in an adjacent layer.

8. The insulating cover apparatus according to claim 5 further comprising a marking rib located on an outer surface of the outermost layer.

9. The insulating cover apparatus according to claim 5 further comprising at least two fins configured on a top of each corner boot and C-channel.

10. The insulating cover apparatus according to claim 5 further comprising a small lip which is located on each of the corner pieces, each of the side wall pieces, and each of the horizontal wall pieces comprising the outermost layer of the insulating cover apparatus.

11. The insulating cover apparatus according to claim 5 in which each of the attachment devices is two pieces wherein one piece is configured as a hook piece and a second piece is configured as a loop piece, with one piece attached to the back of the enclosure and the other piece attached to the surface surrounding the opening in the structure which is to be enclosed.

12. The insulating cover apparatus according to claim 11 in which the attachment devices are magnets and optionally include a metal plate with a sticky surface for attachment to the surface surrounding the opening in the structure to be enclosed.

13. A method for installing an insulating cover apparatus over an A/C unit mounted in a window frame comprising:

providing the insulating cover apparatus of claim 7;

determining a required width of the insulating cover apparatus by measuring an inside width of the window frame;

determining a height of the insulating cover apparatus by measuring a distance from a window sill to a center of a top widow sash;

determining a depth of the insulating cover apparatus by measuring a distance from the window frame to an outside edge of the A/C unit;

determining a number of layers required based on the distance from the window frame to the outside edge of the A/C unit;

attaching the corner pieces for all layers together, attaching the side wall pieces for all layers together, and attaching all the horizontal wall pieces for all layers together;

sliding the attached horizontal wall pieces into the corner pieces;

sliding the attached side wall pieces into the corner pieces;

installing the gasket on an outer surface of the innermost layer;

placing the top cover on the marking rib and cutting the top cover along a line created by the marking rib;

placing the corner boot on each corner of the top cover;

measuring a distance between adjacent corner boots and cutting the C-channels to match that distance;

pressing each C-channel into place between the corner boots;

placing the insulating cover apparatus back on a wall by lining up each of the pieces of the attachment devices and press fitting the top cover with corner boots and C-channels into the opening in the front of the enclosure.

* * * * *